US005277052A

United States Patent [19]

Braunheim et al.

[11] Patent Number: 5,277,052

[45] Date of Patent: Jan. 11, 1994

[54] APPARATUS FOR FORMING A LEADING EDGE COVER FOR JET ENGINE BLADES

[76] Inventors: Braunheim, 708 Georgian Rd., La Canada, Calif. 91011; David A. Janes, 1721 La Ramada, Arcadia, Calif. 91006

[21] Appl. No.: 902,072

[22] Filed: Jun. 22, 1992

Related U.S. Application Data

[62] Division of Ser. No. 615,975, Nov. 20, 1990, Pat. No. 5,168,741.

[51] Int. Cl.[5] ..... B21D 5/16

[52] U.S. Cl. ..... 72/414; 72/350; 29/889.72

[58] Field of Search ..... 72/350, 351, 379.2, 72/385, 414; 29/889.7, 889.71, 889.72

[56] References Cited

U.S. PATENT DOCUMENTS

| | | | |
|---|---|---|---|
| 3,018,542 | 1/1962 | Clarke et al. | 29/889.72 |
| 3,044,152 | 7/1962 | Stalker | 29/889.72 |
| 3,045,327 | 7/1962 | Clarke et al. | 29/889.72 |
| 3,045,967 | 7/1962 | Clarke et al. | 29/889.72 |
| 5,168,741 | 12/1992 | Braunheim et al. | 72/414 |

FOREIGN PATENT DOCUMENTS

| | | | |
|---|---|---|---|
| 723220 | 7/1942 | Fed. Rep. of Germany | 72/414 |
| 2450624 | 5/1975 | Fed. Rep. of Germany | 72/350 |
| 0178125 | 10/1984 | Japan | 72/414 |
| 07211179 | 8/1980 | U.S.S.R. | 72/385 |
| 1263392 | 10/1987 | U.S.S.R. | 72/350 |

*Primary Examiner*—David Jones
*Attorney, Agent, or Firm*—Fulwider Patton Lee & Utecht

[57] ABSTRACT

A apparatus for moldng a stainless steel sheet into a complex airfoil-shaped cover for the leading edge of a jet engine blade wherein the sheet is positioned between a male and female mold having an airfoil-shaped protrusion and recess, respectively, on either side of which are disposed a plurality of pairs of complementary tongue and grooves of shorter length than that of the recess and protrusion. After the sheet is removed from between the molds the portion formed between the recess and protrusion is trimmed to the shape of the cover.

4 Claims, 7 Drawing Sheets

FIG. 1
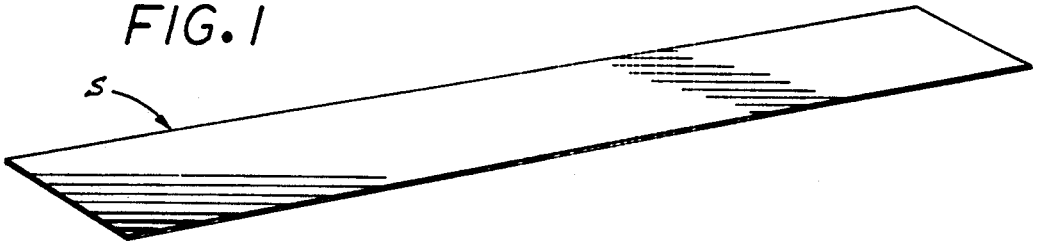
FIG. 2
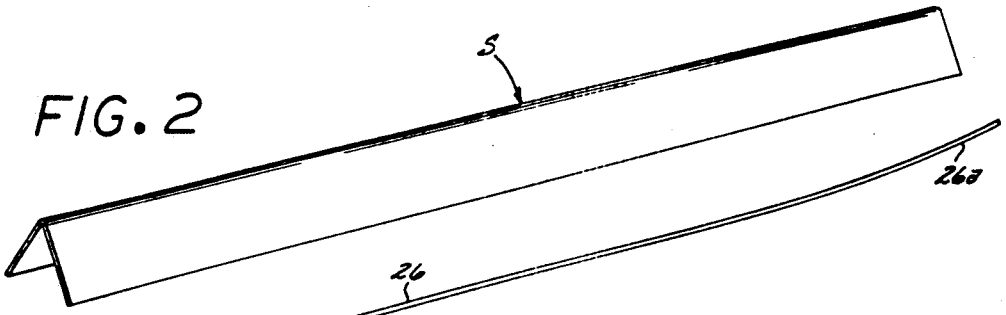
FIG. 3
FIG. 5
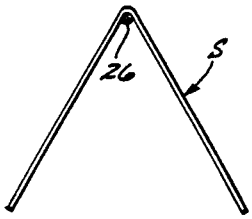
FIG. 4
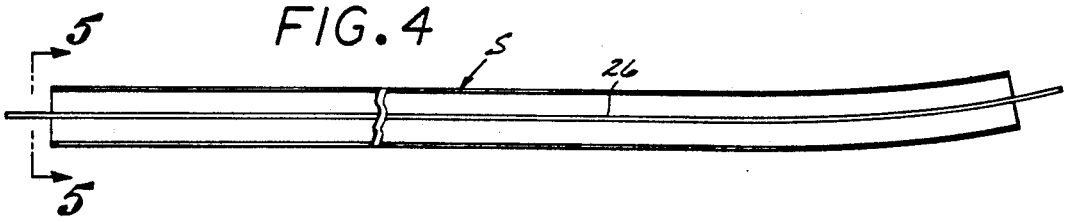
FIG. 6
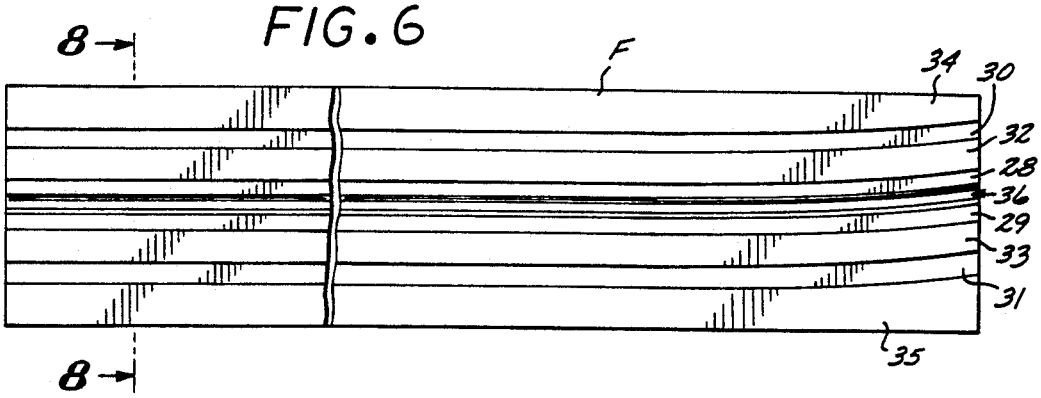

APPARATUS FOR FORMING A LEADING EDGE COVER FOR JET ENGINE BLADES

This is a divisional of copending application Ser. No. 07/615,975, filed on Nov. 20, 1990, now U.S. Pat. No. 5,168,741.

BACKGROUND OF THE INVENTION

This invention relates to a method and apparatus for forming stainless steel sheet metal into a protective cover for the leading edge of a jet engine blade.

Under current practice, metallic covers are bonded onto the leading edge of jet engine blades, especially blades made of composites, in order to protect them from external damage. Such covers are generally formed by a process wherein a metallic mandrel is shaped to the exact contour of the leading edge of a blade. The mandrel is then placed in a plating bath and a metal, usually nickel, is electrodeposited on the surface of the mandrel. After a sufficient thickness of nickel is collected on the mandrel, it is removed from the plating solution and the nickel material is peeled off of the mandrel and used as a blade leading edge cover. A serious disadvantage of electrodeposited nickel leading edge covers is their lack of ductility resulting in shattering and/or cracking in use. Also, the electrodepositing process is both slow and costly.

What has been needed and heretofore unavailable is a process by which stainless steel sheet metal can be formed into a protective cover for the leading edge of jet engine blades. The system of the present invention satisfies this need.

SUMMARY OF THE INVENTION

The method and apparatus of the present invention significantly reduces the cost of production of jet engine blade covers while providing covers affording a long and useful service life.

The present invention is directed to a method and apparatus for forming stainless steel sheet metal into a cover so configured as to match the exact contour of the leading edge of a jet engine blade. The leading edge tip of the cover slightly curves to one side all along the length of the cover, but the curve becomes more pronounced at the outer end of the blade cover. Current methods of forming stainless steel sheet metal into a desired shape generally utilize molds that have flat surfaces everywhere except for the area where a male mold is pressed into a female mold to produce the shape of the desired object. Such methods cannot produce the complex airfoil-shaped contour of the leading edge of a jet engine blade because the stainless steel sheet would either tear as it is forced to bend around sharp corners of the mold, or it would wrinkle if too much sheet metal were fed into the female mold. Furthermore, such prior art methods cannot provide a concave curvature at the rear surface of the blade cover since it is not possible for the male portion of the mold to fully fit inside the female portion along the rear surface of the cover, i.e., to provide for negative draft. In addition, in order to produce acceptable leading edge covers for jet engine blades, it is essential to limit the variation in the thickness of the finished cover to a maximum of about 7 to 8 per cent. However, current methods of forming sheet metal parts cannot achieve this goal. Instead such methods provide a finished product that is considerably thinned at certain locations of the part.

The method and apparatus of invention solves these problems by utilizing a molding press having special male and female molds provided with rectangular-shaped tongues and grooves along the length of the molds, which secure the sheet metal in place as the press is lowered and permits the metal to flow into the desired complex airfoil-shaped configuration without tearing or wrinkling and yet retain a substantially even thickness over the entire area of the metal. Once the stainless steel sheet is formed into the desired shape, the press is released and the resulting metal part is cut at its edges along its length to define a completed blade cover. The resulting blade cover is bonded to the leading edge of a jet engine blade. Such method and apparatus offers considerable cost savings over the prior art electrodepositing method of forming jet engine blade leading edge covers. Moreover, jet engine blade leading edge covers formed in accordance with such method and apparatus afford a much longer service life than can be obtained with electrodeposited nickel leading edge covers.

Other features and advantages of the present invention will become apparent from the following detailed description thereof and the accompanying exemplary drawings.

BRIEF DESCRIPTION OF THE DRAWINGS

FIG. 1 shows a flat sheet of stainless steel that will be formed into a jet engine blade leading edge cover by a preferred method and apparatus embodying the present invention.

FIG. 2 shows the stainless steel sheet of FIG. 1 folded in half and bent into a "V"-shape along its length.

FIG. 3 shows a copper bar that is bent into the contour of the cover's leading edge.

FIG. 4 shows the copper bar placed in the groove of the V-shaped stainless steel sheet of FIG. 2 and the latter bent in the same shape as the copper bar during a preliminary step in such method.

FIG. 5 is a cross-sectional view of the copper bar and stainless steel sheet shown in FIG. 4.

FIG. 6 is a top plan view of a female mold used to form the V-shaped stainless steel sheet into the desired shape.

DETAILED DESCRIPTION OF A PREFERRED EMBODIMENT OF THE INVENTION

A preferred embodiment of the method and apparatus of the present invention shown in FIGS. 1–25 is designed to inexpensively produce stainless steel protective covers that can be bonded onto the leading edge of jet engine blades. The leading edge of jet engine blades, particularly blades formed of composite materials are prone to external damage and must be protected. The leading edge of these blades are configured with an airfoil-shaped cross-section. In order that such airfoil cross-section not be disturbed it is essential that a protective cover for the blade to conform exactly to the leading edge blade configuration and must also be made of a thin material.

Figure 17:
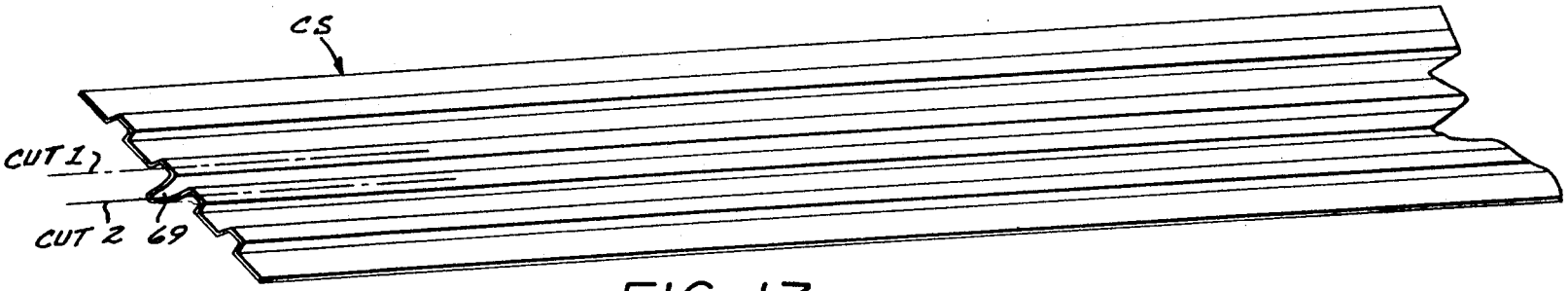
FIG. 17 is a broken perspective view of the formed stainless steel sheet of FIG. 14.
Figure 18:
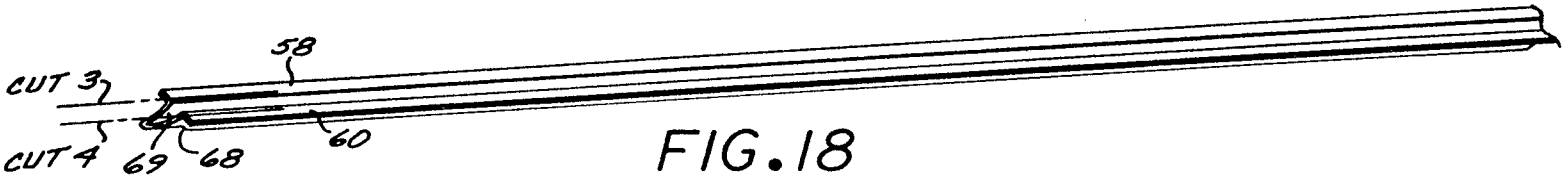
FIG. 18 is a broken perspective view of the stainless steel sheet of FIG. 17 after it is cut along lines 1 and 2.
Figure 19:
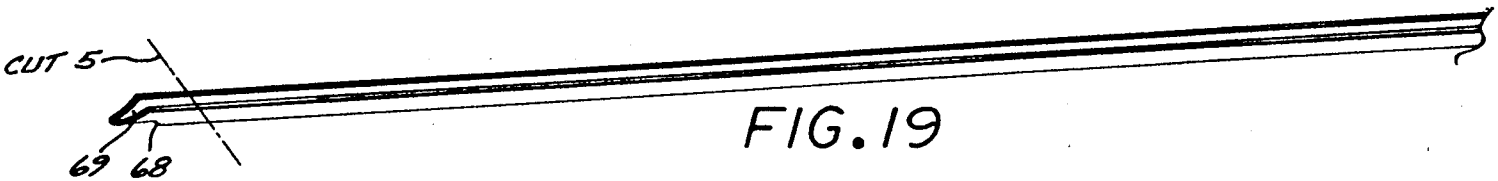
FIG. 19 is a broken perspective view of the stainless steel sheet of FIG. 18 before it has been cut along line 5.
Figure 20:
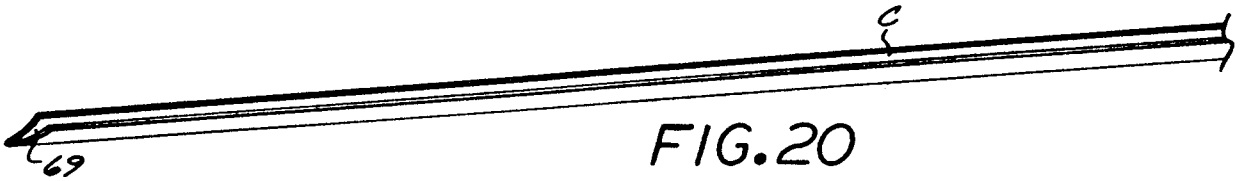
FIG. 20 is a broken perspective view of the leading edge cover of FIG. 19 after it has been cut along line 5 of FIG. 19.
Figure 21:
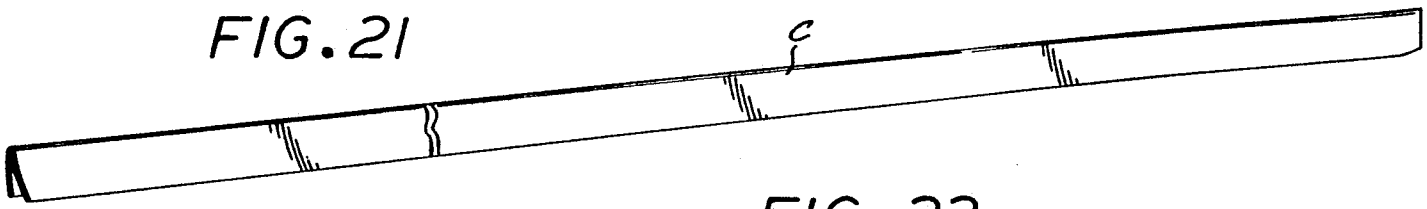
FIG. 21 is a perspective view of a completed leading edge cover.
Figure 22:
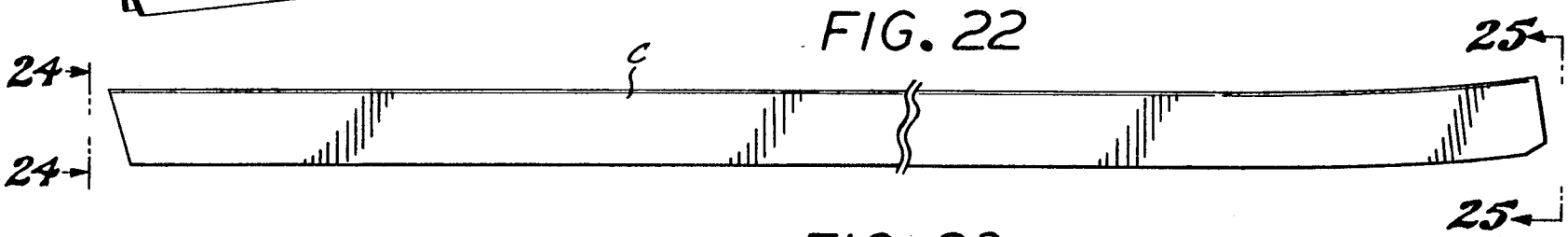
FIG. 22 is a side elevational view of the completed leading edge cover.
Figure 23:
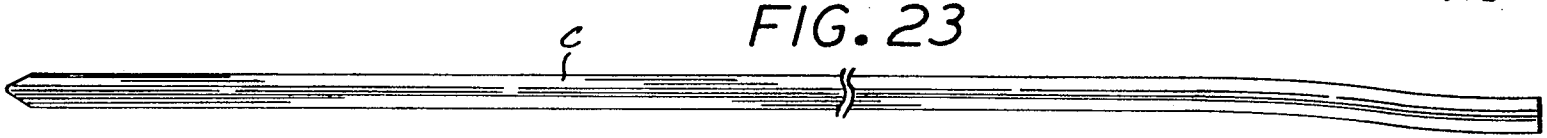
FIG. 23 is a top plan view of the completed cover.
Figure 24:
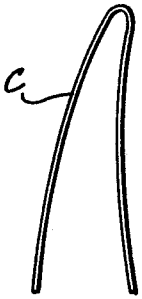
FIG. 24 is an end view of the completed cover taken in an enlarged scale along line 24—24 of FIG. 22.
Figure 25:
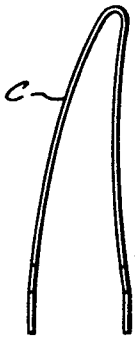
FIG. 25 is an end view of the opposite side of the cover taken in enlarged scale along line 25—25 of FIG. 22.

As indicated in the drawings, a jet engine blade leading edge cover C formed in accordance with a preferred method and apparatus embodying the invention is formed from a thin, flat, rectangular sheet S of a high nickel stainless steel, such as Inconel, shown in FIG. 1, which is deformable into a shape-retaining configuration. In practice the gauge of such steel may approximate 0.03 to 0.015. Such flat sheet S of stainless steel is formed into a completed cover C utilizing a conventional power operated press (not shown) fitted with male and female molds M and F having opposing complementary cavities and projections, between which the sheet S is positioned whereby such sheet will be shaped into a corrugated strip CS shown in FIG. 17 when the male and female molds are urged together by the press. The portions of the corrugated strip CS outwardly of its generally V-shaped mid section are cut-off, as indicated at FIGS. 17 and 18 to provide the completed leading edge cover C shown in FIGS. 20–25.

More particularly, and referring first to FIGS. 1 and 2, the rectangular sheet S is somewhat longer than the length of the desired jet engine blade cover. The first step in forming such cover is to fold the sheet S into an inverted V-shape along its length, as indicated in FIG. 2. Referring now to FIG. 3, a copper bar 26 bent into the exact longitudinal shape of the front of the leading edge of such blade, i.e., so that it is generally straight throughout its length except that at one end of the bar it is curved both sideways and upward as indicated at **26*a* following the typical shape of jet engine blades. As is evident from FIGS. 4 and 5, the copper bar 26 is placed in the groove defined by the closed upper end of the V-shaped stainless steel sheet S and by applying a small amount of force, such as by hand, the flexible V-shaped sheet S can be forced to follow the shape of the copper bar 26. The V-shaped sheet S and copper bar 26** is then positioned between the female mold F and male mold M of a conventional power-operated press (not shown).

Figure 7:
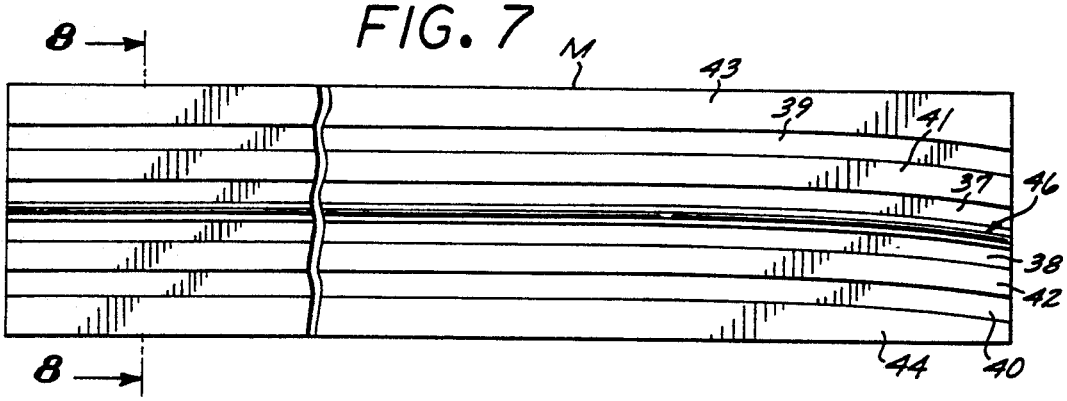
FIG. 7 is a view of a male mold used to form the stainless steel sheet into the desired shape taken from below such mold and looking up theretowards.
Figure 7:
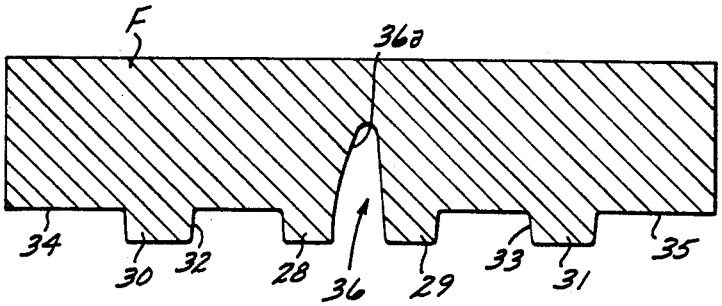
Figure 8:
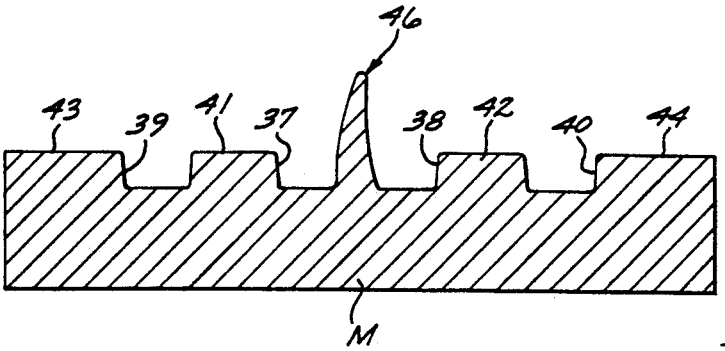
FIG. 8 is a vertical cross-sectional view taken in enlarged scale along 8—8 of FIG. 7.

As shown in FIGS. 6 and 8, the female mold F is formed with two sets of alternating generally rectangular-shaped pairs of tongues 28, 29, and 30, 31, and with two sets of pairs of grooves 32, 33 and 34, 35 disposed on opposite sides of a generally airfoil-shaped central recess generally designated 36 that is deeper that the grooves. The concave surface **36*a* of recess 36 conforms to the convex surface of a jet blade (not shown) for which cover C is intended. The male mold M shown in FIGS. 7 and 8 is formed with alternating generally rectangular-shaped sets of pairs of grooves 37, 38 and 39, 40, and with alternating sets of pairs of tongues 41, 42 and 43, 44 disposed on opposite sides of an upstanding curvalinear airfoil-shaped protrusion generally designated 46 disposed in the center of the male mold. The configuration of such protrusion 46 corresponds to the shape of the leading edge of the jet engine blade for which the cover is intended. The airfoil-shaped protrusion 46** extends upwardly beyond the height of the tongues of male mold M.

The grooves of the female mold F are complementary to the tongues of the male mold M and vice versa, and the recess 36 of the female mold F receives the protrusion 46 of the male mold M. The purpose of the grooves and tongues is to allow the stainless steel sheet S to smoothly flow into the desired configuration as the male mold M pulls the sheet S down into the female mold F in a manner to be described hereinafter.

Figure 9:
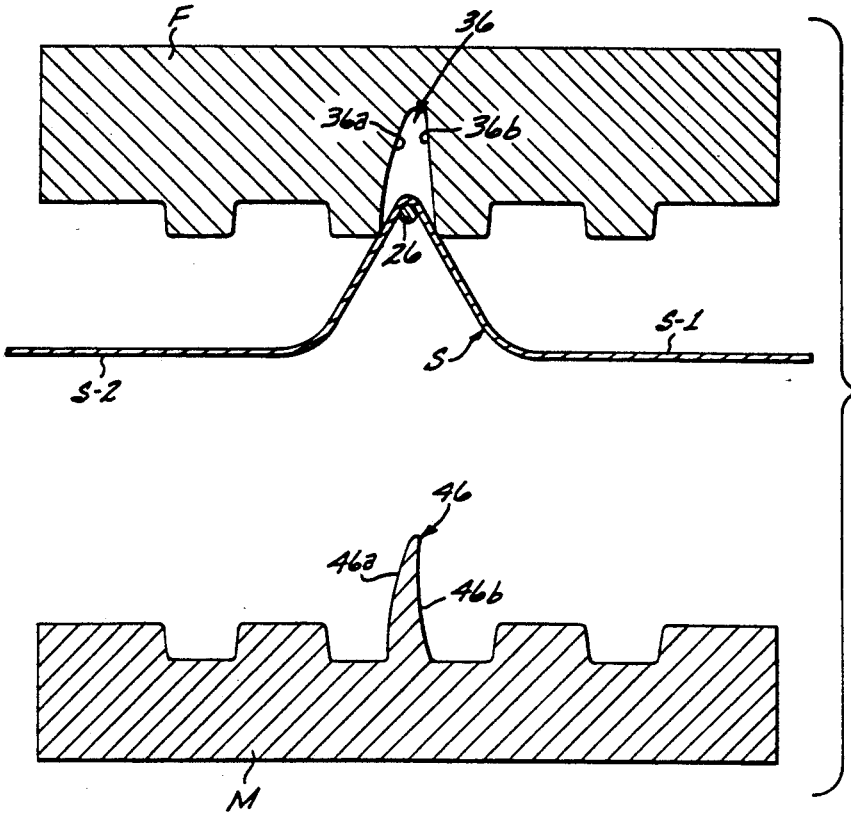
FIG. 9 is a vertical cross-sectional view showing the stainless steel sheet of FIG. 5 positioned between the male and female molds after its legs have been flared outwardly.
Figure 10:
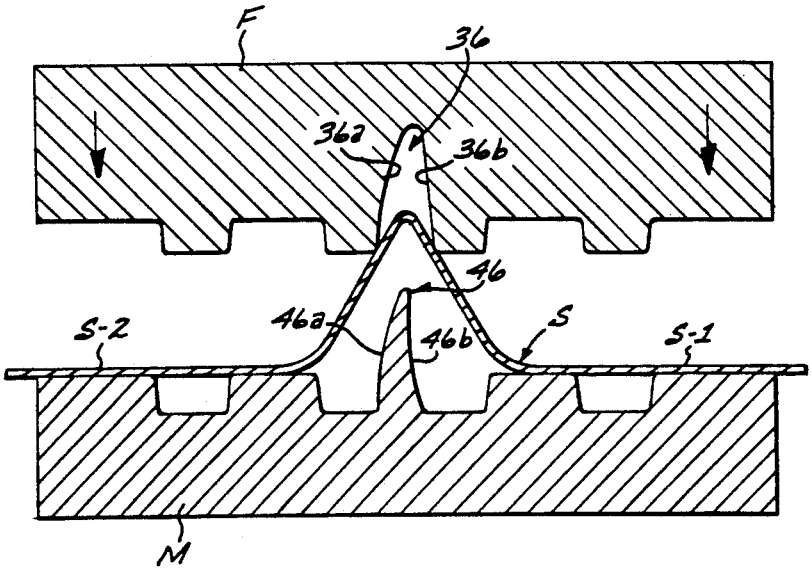
FIG. 10 is a vertical cross-sectional view similar to FIG. 9, but with the copper bar removed, with the male mold being lowered down onto the female mold of the lower half of FIG. 9.

Referring now to FIGS. 9 and 10, with the molding press in its open position, the V-shaped sheet S is positioned between the male and female molds, the copper bar 26 being held within the top of such sheet. The intermediate portion of the legs S-1 and S-2 of the sheet are flared horizontally, as by hand. Thereafter, the female mold is lowered towards the male mold so as to dispose the legs S-1 and S-2 of the V-shaped sheet upon the upper surface of the male mold. The copper bar 26 is removed from within the top of the V-shaped sheet.

Figure 11:
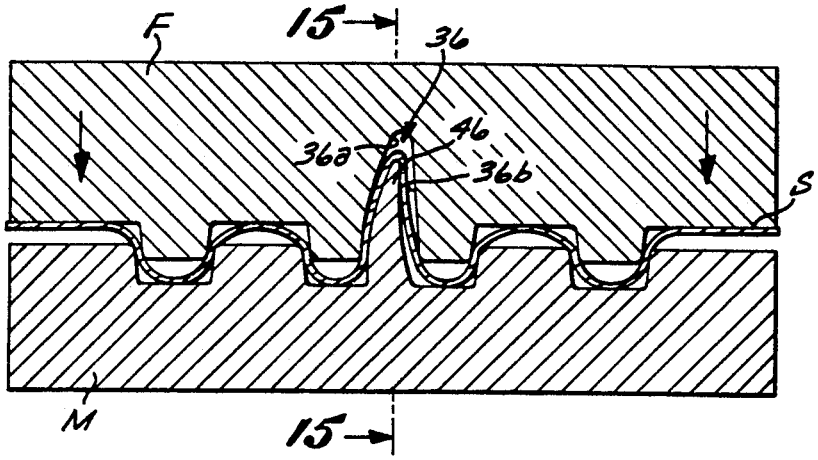
FIG. 11 is a vertical cross-sectional view showing the stainless steel sheet being formed into an initial shape as the female mold approaches the male mold.

Referring now to FIG. 11, as the female mold F continues its downward movement towards the male mold M towards a closed position, contact between the tongues and grooves of the mold pieces with sheet S will cause the portions of the sheet S outwardly of protrusion 46 to deform arcuately within the contours of the tongues and grooves, the sheet being bent gradually in following the contours of the tongues and grooves. The speed at which the female mold F is lowered should be adjusted so as to permit such bending to occur, as differentiated from the fairly rapid closing speed at which a mold piece is generally urged towards its complementary mold piece to stamp out a workpiece. While the portions of the sheet S outwardly of airfoil protrusion 46 are being curved as indicated in FIG. 11, the mid-portion of the sheet will be gradually pulled downwardly by the female mold so as to begin to assume the airfoil shape of protrusion 46. As the female mold continues its downward movement, the material of the sheet S will smoothly flow relative the tongues and grooves until the side portions of the sheet outwardly of its center portion are engaged by the surfaces of the tongues and grooves.

Figure 12:
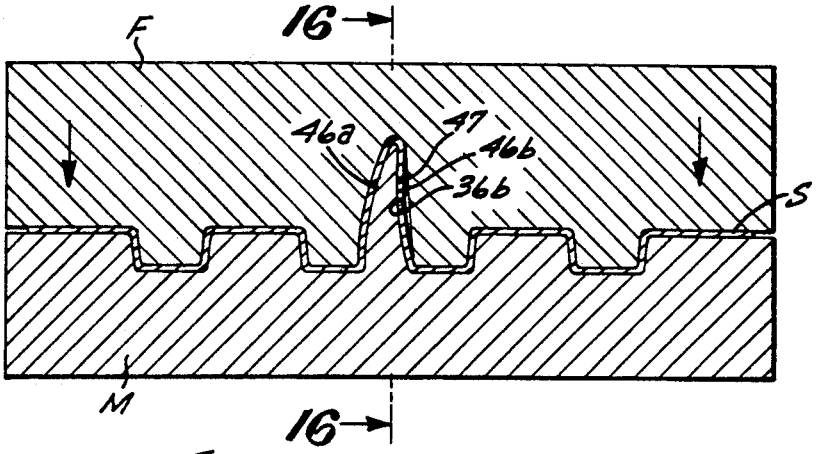
FIG. 12 is a vertical cross-sectional view showing the stainless steel sheet completely formed into its final shape by the complete contact between the female mold and the male mold.

Contact with tongues and grooves will secure such side portions relative to the mold pieces as the side surfaces of recess 36 cooperate with the side surfaces of protrusion 46 to ultimately form the mid-portion of the sheet into the airfoil configuration of the protrusion shown in FIG. 12 when the molds reach a closed position. With continued reference to FIG. 11, protrusion 46 extends upwardly higher than the grooves 32, 33 and 34, 35 of the female mold. At this time, the material of the sheet is not in contact with the top of protrusion 46. Finally, as seen in FIG. 12, the two molds are fully closed. It should be noted that the sheet has been pressed between the tongues and grooves and the center portion thereof is in abutting engagement with protrusion 46. At this time, the portion of sheet S which is disposed between the convex surface 46*a* of the protrusion 46 and the concave surface of recess 36 and this sheet portion is formed into the convex shape of a jet blade for which cover C is intended. At the same time the portion of sheet S opposite such convex shaped portion is formed into a concave shape corresponding to the concave surface 46*b* of protrusion 46, such concave shape also corresponding to the concave surface of a jet blade for which cover C is intended. Such negative draft concave shape is imposed upon the material of sheet S even though the adjoining surface 36*b* of recess 36 is straight-sided in order that the molds may undergo relative vertical movement without binding. This forming phenomena takes place because the segment 47 of sheet S which is formed into a concave shape is longer than the distance between the upper and lower ends of protuberance 46, and the upper and lower ends of such segment 47 are trapped between the upper and lower molds at the top and the bottom of the recess 36 on the concave side of protrusion 46. Hence, sheet segment 47 must flex towards the concave surface 46*b* of protuberance 46. The ability of the tongues and grooves to hold the sheet S (particularly at points 61 and 63) at the last stage just before the center portion of the sheet is pulled onto the protrusion 46 to create the airfoil curvature is believed critical. Currently used methods of sheet metal forming do not have the capability to hold sheet material and at the same time to allow such material to be smoothly pulled into a desired configuration without tearing or wrinkling, and without extreme thinning of the metal.

Figure 15:
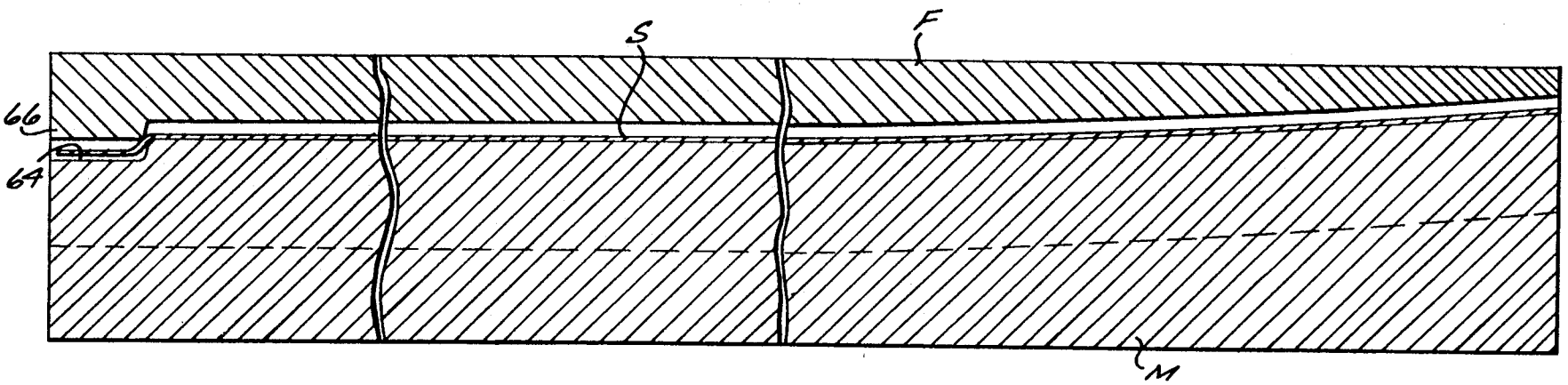
FIG. 15 is a vertical cross-sectional view taken along line 15—15 of FIG. 11 showing a notch at one end of the male mold.
Figure 16:
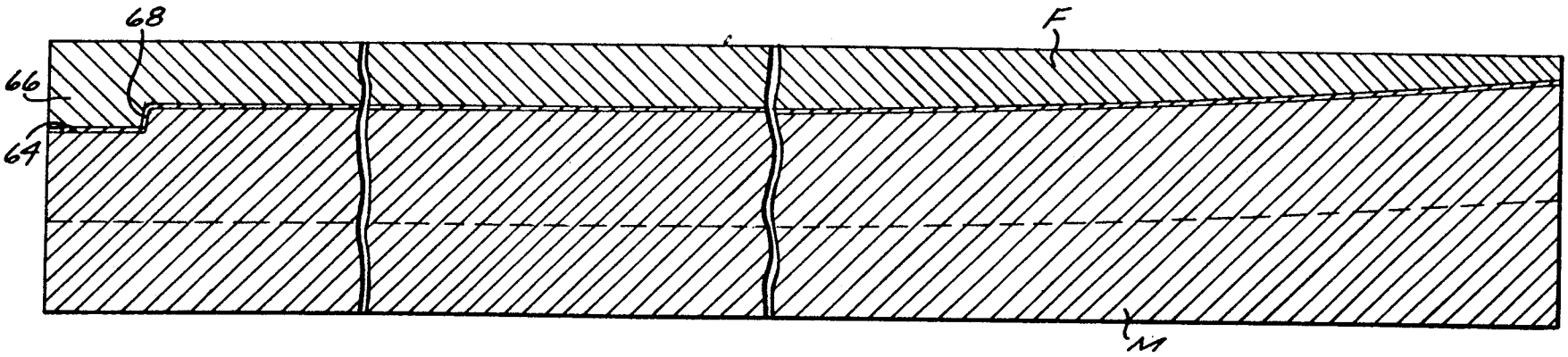
FIG. 16 is a vertical cross-sectional view taken along line 16—16 of FIG. 12 showing the same notch.

Referring now to FIGS. 15 and 16, a transverse notch 64 is formed at the left portion of the male mold's protrusion 46 to lock the stainless steel sheet S in place longitudinally and thereby prevent it from "walking" or sliding while it is being formed between the male and female molds. A complementary depending finger 66 fits into notch 64 to force the end of the sheet downwardly within the notch forming a locking step 68 on such end of the sheet.

Figure 13:
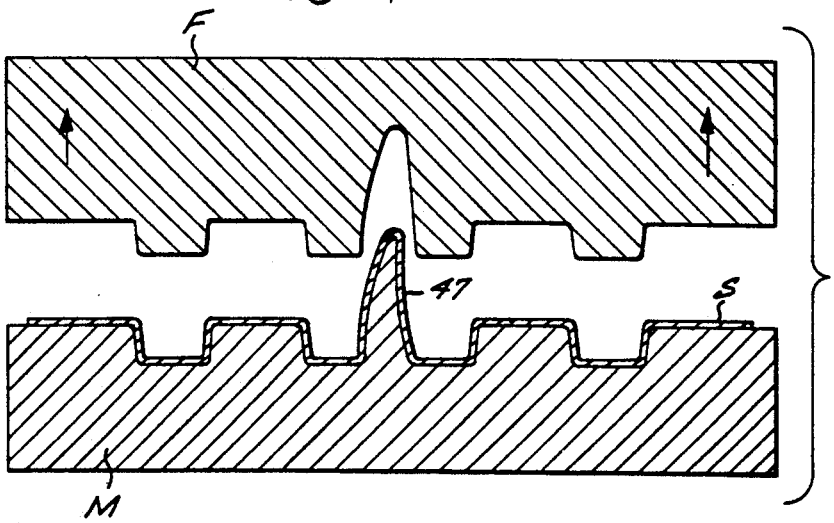
FIG. 13 is a vertical cross-sectional view showing the separation of the female mold from the male mold, with the stainless steel sheet remaining on the male mold.
Figure 14:
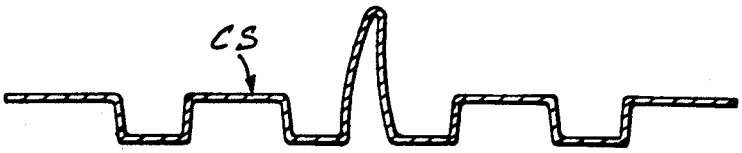
FIG. 14 is a vertical cross-sectional view of the stainless steel sheet after it is formed into its final shape and has been peeled off of the male mold.

After the center portion of the sheet S has been formed into its desired airfoil shape, the two molds are separated from each other as indicated in FIG. 13, and the corrugated sheet CS is peeled off of the male mold M, at which time it has the appearance depicted in FIGS. 14 and 17. As shown in FIG. 17, the corrugated sheet CS is then cut longitudinally along lines "CUT 1" and "CUT 2" just outwardly of the airfoil section 69 of the sheet so that a short web 58 and 60 of the sheet metal extends beyond distal ends of the airfoil section. As shown in FIG. 18, these webs 58 and 60 are cut away from the arcuate section of the sheet along "CUT 3" and "CUT 4". It is also necessary to cut away the locking step 68 formed by notch 64 and finger 66 along "CUT 5". After this cutting step on the left-hand end of the cover, the right-hand end thereof is trimmed to a desired configuration, and the finished protective cover C will appear as shown in FIGS. 20–24.

The completed cover C can then be epoxy-bonded in a conventional manner, as by autoclaving, onto the leading edge of a jet engine blade (not shown). Protective covers for jet engine blades of varying contours, and sizes may be formed by the aforedescribed method and apparatus by making molds that match the contour of each such blade. Depending on the life of the material used to build the molds, each set of molds can be used repeatedly to produce large numbers of leading edge protective covers at a comparatively low cost.

From the foregoing description it will be apparent that the method and apparatus of the present invention provides for an improved and less expensive method of making protective covers for the leading edge of jet engine blades. By using the same molds repeatedly large numbers of leading edge covers can be produced in a relatively short period of time, thereby resulting in reduced production cost per unit compared to the electrodepositing method. Furthermore, stainless steel is a more desirable material than nickel because it lasts longer, is less expensive, stronger, and is more ductile. Use of such a material as a leading edge cover will extend the life of the blades, and as a result is likely to reduce the costs of inspection and maintenance of jet engines.

Current methods of forming sheet metal into various shapes cannot produce complex airfoil-shaped jet engine leading edge protective covers because of tearing or wrinkling of stainless steel as it is stretched in the molds. Use of the multiple tongues and grooves in the molds utilized by the method of the present invention solves this problem and results in a smooth steel cover that has an even thickness all throughout.

While a particular form of the invention has been illustrated and described, it will be apparent to those familiar with the art that various modifications and improvements can be made without departing from the scope of the invention as defined by the following claims.

We claim:

1. Mold apparatus for forming an airfoil-shaped jet engine blade leading edge cover having a concave side and a convex side from a deformable shape-retaining metallic sheet of greater width than the blade leading edge, said mold apparatus comprising:

a non-deformable male mold having an upstanding vertical protrusion conforming to the concave-convex shape to be imparted to said cover;

a non-deformable female mold having an upstanding recess with a convex side conforming to the shape of the blade leading edge and a concave opposite side which is formed generally straight-sided whereby the molds may undergo relative movement towards and away from one another without binding;

a plurality of complementary tongues and grooves disposed on either side of the recess and protrusion; and power operated means for urging the molds together to a closed position wherein they capture the sheet snugly therebetween at a speed which causes the side portions of the sheet outwardly of the recess and protrusion to deform accurately so as to follow the contours of the protrusion and recess while the tongues and grooves anchor the side portions of the sheet as the surfaces of the recess and protrusion form the mid-portion of the sheet into the completed shape of the blade leading edge when the molds reach a closed position.

2. Mold apparatus as set forth in claim 1, wherein the height of the recess and the protrusion is greater than the height of the tongues and grooves.

3. Mold apparatus as set forth in claim 1, wherein a complementary notch and finger are interposed between the male and female molds in alignment with the protrusion and recess to engage the sheet as the mold is urged together and thereby lock the sheet longitudinally in place.

4. Mold apparatus as set forth in claim 2, wherein the height of the recess and the protrusion is greater than the height of the tongues and grooves.

* * * * *